US005433324A

United States Patent [19]

Leonard

[11] Patent Number: 5,433,324

[45] Date of Patent: Jul. 18, 1995

[54] MEDICINE REMINDER DEVICE

[76] Inventor: Joe H. Leonard, 3005 Meadow Cove Point, Knoxville, Tenn. 37922

[21] Appl. No.: 81,025

[22] Filed: Jun. 22, 1993

[51] Int. Cl.[6] ..... B65D 83/04

[52] U.S. Cl. ..... 206/534; 206/446; 206/459.1

[58] Field of Search ..... 206/534, 446, 459.1; 40/506, 493, 310; 283/117

[56] References Cited

U.S. PATENT DOCUMENTS

| | | | |
|---|---|---|---|
| 1,731,749 | 2/1929 | Miller et al. . | |
| 2,450,949 | 10/1948 | Gattuccio et al. . | |
| 2,814,267 | 11/1957 | Goldstein et al. . | |
| 2,893,163 | 7/1959 | Hazel, Jr. . | |
| 3,744,672 | 7/1973 | Dangles et al. | 206/534 |
| 3,847,324 | 11/1974 | Uchanski et al. . | |
| 4,288,006 | 9/1981 | Clover, Jr. | 206/534 |
| 4,705,182 | 11/1987 | Newel-Lewis | 206/534 |
| 4,782,963 | 11/1988 | Hunter | 206/534 |
| 4,802,438 | 2/1989 | DeJonge . | |
| 4,877,119 | 10/1989 | Hosking | 206/534 |
| 5,046,605 | 9/1991 | Levrant | 206/534 |

*Primary Examiner*—Bryon P. Gehman
*Assistant Examiner*—Thomas P. Hilliard
*Attorney, Agent, or Firm*—Pitts and Brittian

[57] ABSTRACT

A medicine reminder device for reminding an individual taking medication of the time the next dosage should be taken. The medicine reminder device includes a base structure and a time indicator. In the preferred embodiment, the base structure includes a foundation, a cylindrical support which extends upward from the foundation, and an annular lip which extends outward from the cylindrical support. The foundation has a reference mark imprinted thereon. In the preferred embodiment, the time indicator is a ring assembly which rotates around the cylindrical support. The ring assembly defines an annular groove which receives the annular lip to secure the ring assembly to the base structure. The ring assembly has sequential time indicia imprinted thereon. To use the medicine reminder, the medicine bottle of choice is placed inside the cylindrical support, and the ring assembly is rotated such that the selected time from the sequential time indicia is aligned with the reference marker to indicate the time of day that a dose of medicine has been or is to be taken.

9 Claims, 2 Drawing Sheets

MEDICINE REMINDER DEVICE

TECHNICAL FIELD

This invention relates to the field of indicators and more specifically to an indicator which provides a time scale for reminding a user of the time to take his medication and also to indicate if a user has missed his last dose.

BACKGROUND ART

Medicine reminder devices have been used for years as a way to remind individuals taking medication of the time to take their next dose or the time they took their last dose.

In the past, medicine reminder devices often took the form of a bottle cap having time indicia and a means for indicating a particular time. Typical of the art is the device disclosed in U.S. Pat. No. 2,450,949 issued to S. Gattuccio on Oct. 12, 1948. The major disadvantages with the bottle cap form of medicine reminder devices is that the traditional bottle cap design must be drastically altered to provide time indication and the bottle cap fits only one size bottle opening.

Other devices have been produced to overcome the problem of redesigning bottle caps. For example, the device disclosed in U.S. Pat. No. 4,802,438 issued to A. DeJonge on Feb. 7, 1989 teaches a container with a dosage time indicator collar. This device relieves the problem of having to redesign the container's cap, but the collar fits one particular bottle size and shape.

Therefore, it is an object of this invention to provide a medicine reminder device which can be used with medicine bottles of different sizes and shapes.

Further, it is another object of the present invention to provide a medicine reminder device which supports a medicine bottle within its base such that the medicine bottle can not be knocked over.

Yet another object of the present invention is to provide a medicine reminder device that does not have to be picked up or otherwise manipulated to view the time reminding portion.

Still, another object of the present invention is to provide a medicine reminder device that is not attached to the medicine bottle.

Disclosure of the Invention

Other objects and advantages will be accomplished by the present invention which serves to remind an individual of the time he is to take his next dose of a medication or of the time of his last dose. The medicine reminder device of the present invention includes a base structure for receiving a medicine bottle and a time indicator which is displayed on the exterior of the base structure. The time indicator indicates the time of day a dose of medicine has been or is to be taken.

The base structure includes a foundation, a cylindrical support, which extends upward from the foundation, and an annular lip which extends from an upper portion of the cylindrical support. The foundation bears a reference mark.

The time indicator is a ring assembly. The ring assembly defines an annular groove which cooperates with the annular lip of the base structure to secure the ring assembly to the base structure. The ring assembly is secured to the base structure in a manner such that it rotates around the cylindrical support. The ring assembly bears sequential time indicia.

To indicate the desired dosage time, the selected time of the sequential time indicia is aligned with the reference mark on the foundation to indicate the time the next dose of medication is to be taken or the time the last dose of medication was taken.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A medicine reminder device incorporating various features of the present invention is illustrated generally at 10 in the Figures. The medicine reminder device 10 is designed to accommodate medicine bottles of different sizes and shapes. The medicine reminder device 10 is also designed to simplify reading the indicia on the device 10. Moreover, in the preferred embodiment the medicine reminder device 10 is designed to support a medicine bottle such that the bottle can not be knocked over.

The medicine reminder device 10 is comprised generally of a base structure 12, and a time indicator 30. The base structure 12 receives a medicine bottle 70 within the base structure 12. The time indicator 30 denotes the time of day a dose of medicine has been or is to be taken. The time indicator 30 is displayed on the exterior of the base structure 12.

Figure 4:
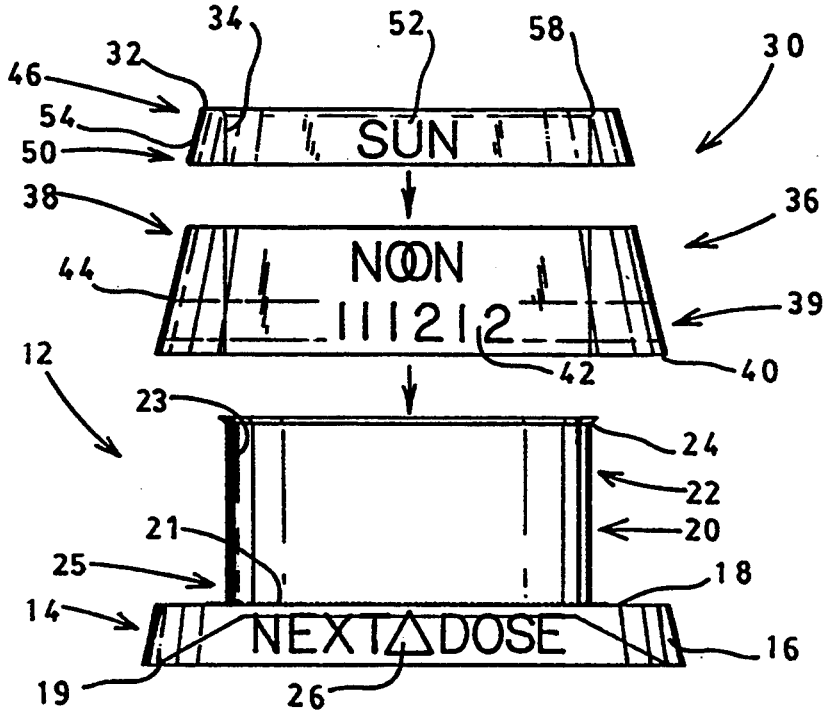
FIG. 4 illustrates an exploded view of the medicine reminder device of FIG. 1.
Figure 5:
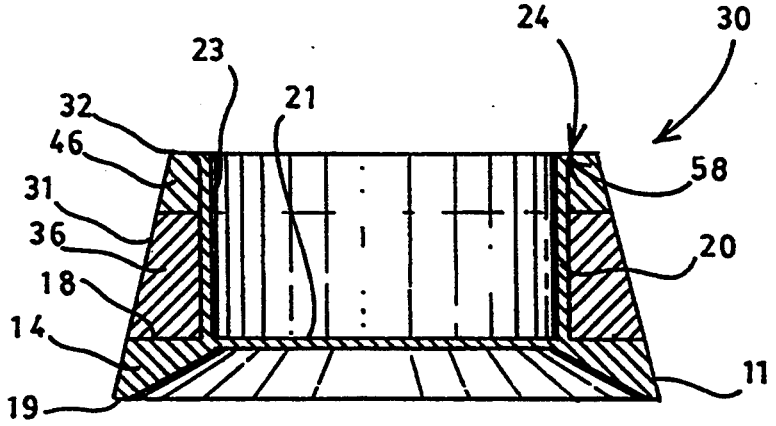
FIG. 5 illustrates a side elevational view, in section, of the medicine reminder device taken along 5—5 of FIG. 1.

The base structure 12, the preferred embodiment of which is most clearly shown in FIG. 4, includes a foundation 14, a cylindrical support 20 which extends upward from the foundation 14, and a retainer for retaining the time indicator 30 on the base structure 12. In the preferred embodiment, the retainer is an annular lip 24 which extends radially away from the upper portion 22 of the cylindrical support 20.

The foundation 14 defines an outer surface 16, an upper surface 18, and a bottom surface 19. In the preferred embodiment, the outer surface 16 of the foundation 14 bears a reference mark 26, as shown in FIGS. 1–4. Preferably, the outer surface 16 of the foundation 14 has a frustoconical shape as depicted in FIGS. 1 and 3–5. The bottom surface 19 engages a support surface 72 such as a table. The upper surface 18 is an annular surface which is disposed around the bottom portion 25 of the cylindrical support 20.

Figure 1:
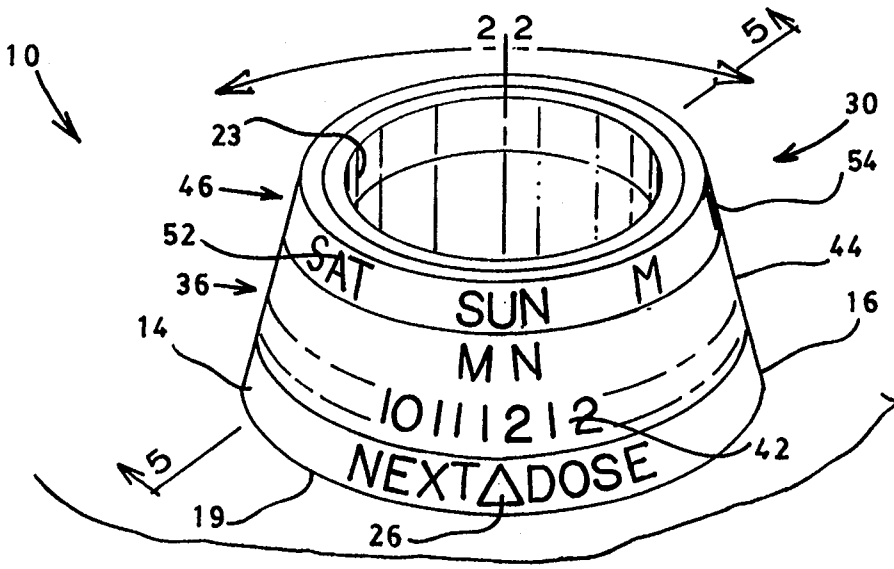
FIG. 1 is a perspective view of the medicine reminder device constructed in accordance with several features of the present invention.
Figure 2:
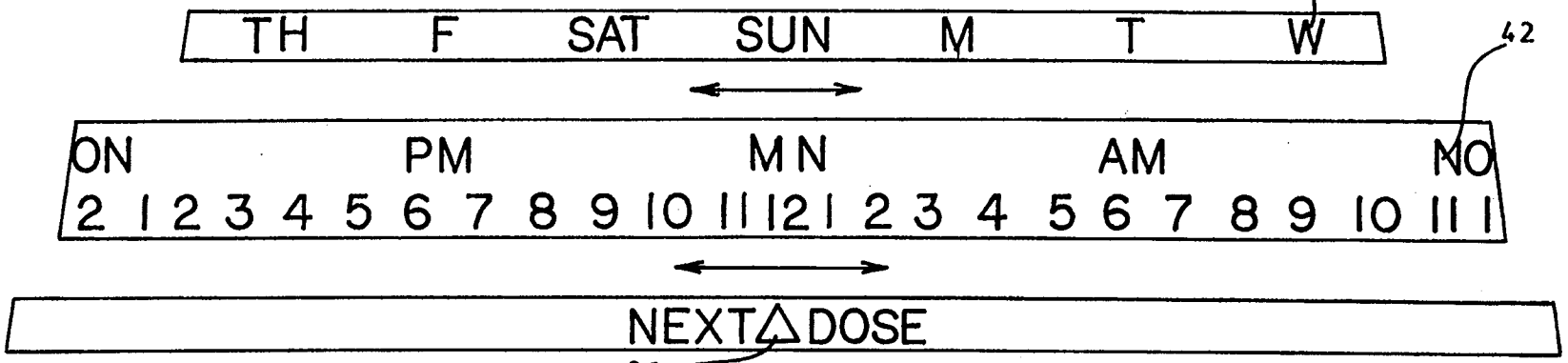
FIG. 2 illustrates a planar view of the perimeters and the indicia carried thereby of the first and second rings and the foundation of FIG. 1.
Figure 3:
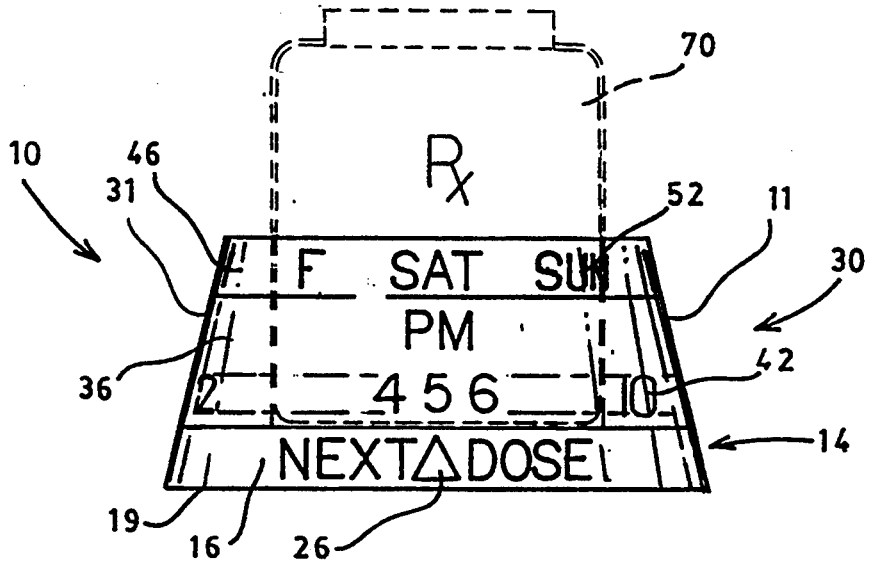
FIG. 3 is a side elevational view of the medicine reminder device of FIG. 1 shown with a medicine bottle, in phantom, carried within the base structure.

The cylindrical support 20 defines an interior surface 23, and a bottom surface 19. The interior surface 23, as shown, is substantially cylindrical to receive bottles of varying sizes and shapes. It will be understood that any configuration may be used, such as one to closely receive a standard liquid medication bottle. A medicine bottle 70 is received within the interior surface 23 of the cylindrical support 20, as shown in FIG. 3. The medicine bottle 70 rests on the bottom surface 21 of the cylindrical support 20.

In the preferred embodiment, the time indicator is a ring assembly 30. The ring assembly 30 is comprised of at least one ring. The ring assembly 30 defines an inner wall 34, a bottom surface 40, an upper surface 32 and an outer surface 31. The ring assembly 30 is secured to the base structure 12 in a manner such that the ring assembly 30 rotates around the cylindrical support 20. The bottom surface 40 of the ring assembly 30 rests on the upper surface 18 of the foundation 14. In the preferred embodiment, the ring assembly 30 is secured to the base structure 12 by the cooperation between the annular lip 24 of the base structure 12 and a corresponding annular groove 58 in the upper surface 32 of the ring assembly 30 which slidably receives the annular lip 24 in a snap-fit fashion. The annular lip 24 retains the ring assembly 30 from movement in a vertical direction relative to the cylindrical support 20. Further, in the preferred embodiment, the inner wall 34 of the ring assembly 30 is closely received by the cylindrical support 20 such that frictional forces cause the ring assembly 30 to remain in the position designated by the user, most clearly shown in FIG. 5. Preferably, the outer surface 31 of the ring assembly 30 has a frustoconical configuration such that the outer surface 31 of the ring assembly 30 and the outer surface 16 of the foundation 14 cooperate to define a single outer surface 11 which has a frustoconical configuration, as shown in the Figures. The ring assembly 30 and base structure 12 should be fabricated from a rigid material such as plastic. In the preferred embodiment, the ring assembly 30 is comprised of a first ring 36 and a second ring 46, as shown in the Figures.

The first ring 36 rests on the upper surface 18 of the foundation 14 and rotates around the cylindrical support 20. Preferably, the outer surface 44 of the first ring 36 has a frustoconical shape such that the lower portion 39 of the first ring 36 defines substantially the same outer diameter as that of the upper surface 18 of the foundation 14, as shown in FIGS. 1 and 3–5. In the preferred embodiment, the outer surface 44 of the first ring 36 bears sequential time indicia 42 which indicates the time of day in hourly increments with morning, evening, midnight and noon indicators, shown most clearly in FIG. 2. It will be understood that other incremental units may be used.

The second ring 46 rests on the upper portion 38 of the first ring 36 and is rotatably secured to the base structure 12 via the annular lip 24. The second ring 46 defines an annular groove 58 at the upper surface 32 of the second ring 46. The annular groove 58 receives the annular lip 24 such that the first and second ring 36, 46 are rotatably secured around the cylindrical support 20 and are prevented from movement in a vertical direction relative to the cylindrical support 20, shown most clearly in FIG. 5. Preferably, the outer surface 54 of the second ring 46 has a frustoconical shape such that the outer diameter of the lower portion 50 of the second ring 46 defines substantially the same outer diameter as that of the upper portion 38 of the first ring 36. In the preferred embodiment, the outer surface 54 of the second ring 46 bears indicia which indicates each day of the week, as more clearly shown in FIG. 2. It will be noted that the outer surface 44 of the first ring and the outer surface 54 of the second ring 46 define the outer surface 31 of the ring assembly 30.

It will be noted that the ring assembly 30 can include only one ring which rotates around the cylindrical support 20. Preferably, the one ring would bear the sequential time indicia 42 indicating the time of day. Alternatively, the ring assembly 30 may include more than two rings, such as a third ring to indicate minutes within the hour.

Also, it will be noted by those skilled in the art that the reference mark 26 on the foundation 14, and the sequential time indicia 42 on the first ring 36 and the day indicia 52 on the second ring 46 can be switched whereby the reference mark 26 may be imprinted on either the first ring 36 or second ring 46 and either the sequential time indicia 42 or the day indicia 52 may be in the stationary position on the foundation 14.

To use the medicine reminder device 10, a selected medicine bottle 70 is placed within the cylindrical support 20 of the medicine reminder device 10 and the sequential time indicia 42 of the first ring 36 and day indicia 52 of the second ring 46 are aligned with the reference mark 26 on the foundation 14 by rotating the first and second rings 36, 46 to the desired position. The indicia 42, 52 are aligned with the reference mark 26 to indicate the time the next dose of medication is to be taken or the time the last dose of medication was taken. When the medication is taken, the medicine reminder device 10 is adjusted by rotating the first and/or second rings 36, 46 to indicate the desired dosage time.

From the foregoing description, it will be recognized by those skilled in the art that a medicine reminder device offering advantages over the prior art has been provided. It is more economical and all inclusive since special bottle caps or bottles need not be manufactured. Specifically, the medicine reminder device accommodates medicine bottles of various sizes and shapes. The medicine bottle reminder is designed such that time reminding portion can be viewed without manipulating the device. The medicine bottle reminder provides a means for supporting the medicine bottle such that the medicine bottle can not be knocked over.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A medicine reminder device comprising:

a base structure defining a receptacle for receiving the base of a selected medicine bottle, a portion of said base structure defining a cylindrical outer wall, said base structure defining a first outer surface; and a ring assembly including a first ring and a second ring rotatably mounted on said cylindrical outer wall of said base structure, said first ring defining a second outer surface, said second ring defining a third outer surface, said second outer surface and said third outer surface defining a ring assembly outer surface, said ring assembly defining a frustoconical configuration, said first outer surface defining a frustoconical configuration, said first outer surface and said ring assembly outer surface defining selected portions of a cone, one of said outer surfaces carrying a reference mark, one of said outer surfaces carrying a days of week indicia, one of said outer surfaces carrying a sequential time indicia, a selected time from said sequential time indicia and a selected day from said day of the week indicia being cooperatively aligned with said reference mark to indicate a selected dosage time.

2. The medicine reminder device of claim 1 wherein said base structure includes a foundation defining a first bottom surface, a first upper surface and said first outer surface, said first bottom surface for engaging a support surface, said first outer surface carrying said reference mark;

a cylindrical support extending upward from said foundation, said cylindrical support defining said receptacle and said cylindrical outer wall, said cylindrical support defining a second bottom surface and an interior surface for receiving a base of a selected medicine bottle, said first upper surface being an annular surface disposed around said cylindrical support; and a retainer for retaining said ring assembly from linear movement along an axis of rotation.

3. The medicine reminder device of claim 2 wherein said ring assembly further defines a cylindrical inner wall, a third bottom surface, and a second upper surface, said cylindrical inner wall being closely received by said cylindrical outer wall of said cylindrical support, said third bottom surface being supported on said first upper surface, said ring assembly being rotatable with respect to said cylindrical support, one of said second outer surface and said third outer surface carrying said day of the week indicia, another of said second outer surface and said third outer surface carrying said sequential time indicia, a selected time from said sequential time indicia and a selected day from said day of the week indicia being cooperatively aligned with said reference mark to indicate a selected dosage time.

4. The medicine reminder device of claim 3 wherein said first outer surface defines a frustoconical configuration, said second outer surface defines a frustoconical configuration, and said third outer surface defines a frustoconical configuration.

5. The medicine reminder device of claim 3 wherein said retainer includes an annular lip extending radially away from an upper portion of said cylindrical support, said second upper surface defining an annular groove for receiving said annular lip such that said ring assembly is rotatably secured to said cylindrical support.

6. A medicine reminder device comprising:

a base structure defining a foundation, a cylindrical support and an annular lip, said foundation defining a first upper surface, a first outer surface and a first bottom surface, said first outer surface carrying a reference mark, said first bottom surface for engaging a support surface, said cylindrical support extending upward from said foundation, said cylindrical support defining an interior surface and a second bottom surface for receiving the base of a selected medicine bottle, said first upper surface being an annular surface disposed around said cylindrical support; and a ring assembly including a first ring and a second ring, said first ring and said second ring being concentric, said first ring defining a second outer surface, said second ring defining a third outer surface, said ring assembly defining a cylindrical inner wall, a third bottom surface and a second upper surface, said cylindrical inner wall being closely received by said cylindrical support, said third bottom surface being supported on said first upper surface, said second upper surface defining an annular groove for receiving said annular lip such that said ring assembly is secured to said cylindrical support, said ring assembly being rotatable with respect to said cylindrical support, one of said second outer surface and said third outer surface carrying a sequential time indicia, another of said second outer surface and said third outer surface carrying a day of the week indicia, a selected time from said sequential time indicia and a selected day from said day of the week indicia being cooperatively aligned with said reference mark to indicate a selected dosage time.

7. The medicine reminder device of claim 6 wherein said first outer surface of said foundation defines a frustoconical configuration, said second outer surface of said ring assembly defines a frustoconical configuration, and said third outer surface of said ring assembly defines a frustoconical configuration.

8. The medicine reminder device of claim 6 wherein said first outer surface of said foundation defines a cylindrical configuration, said second outer surface of said ring assembly defines a cylindrical configuration, and said third outer surface of said ring assembly defines a cylindrical configuration.

9. A medicine reminder device comprising:

a base structure defining a foundation, a cylindrical support and a retainer, said foundation defining a first upper surface, a first outer surface and first bottom surface, said first outer surface carrying a reference mark and defining a frustoconical configuration, said first bottom surface for engaging a support surface, said cylindrical support extending upward for said foundation, said cylindrical support defining an interior surface and a second bottom surface for receiving the base of a selected medicine bottle, said first upper surface being an annular surface disposed around said cylindrical support; and, a ring assembly including a first ring and a second ring, said first ring and said second ring being concentric, said first ring defining a second outer surface, said second outer surface defining a frustoconical configuration, said second ring defining a third outer surface, said third outer surface defining a frustoconical configuration, said ring assembly defining a cylindrical inner wall, a third bottom surface and a second upper surface, said cylindrical inner wall being closely received by said cylindrical support, said third bottom surface being supported on said first upper surface, said retainer retaining said ring assembly from linear movement along an axis of rotation, said ring assembly being rotatable with respect to said cylindrical support, one of said second outer surface and said third outer surface carrying a sequential time indicia, another of said second outer surface and said third outer surface carrying a day of the week indicia, a selected time from said sequential time indicia and a selected day from said day of the week indicia being cooperatively aligned with said reference mark to indicate a selected dosage time.

* * * * *